US006339404B1

(12) United States Patent
Johnson et al.

(10) Patent No.: US 6,339,404 B1
(45) Date of Patent: Jan. 15, 2002

(54) DIVERSITY ANTENNA SYSTEM FOR LAN COMMUNICATION SYSTEM

(75) Inventors: Greg Johnson, Aptos, CA (US); Don Keilen, Sparks, NV (US)

(73) Assignee: Rangestar Wirless, Inc., Aptos, CA (US)

( * ) Notice: Subject to any disclaimer, the term of this patent is extended or adjusted under 35 U.S.C. 154(b) by 0 days.

(21) Appl. No.: 09/637,301

(22) Filed: Aug. 11, 2000

Related U.S. Application Data

(60) Provisional application No. 60/148,909, filed on Aug. 13, 1999.

(51) Int. Cl.[7] ..... H01Q 21/00

(52) U.S. Cl. ..... 343/794; 343/702; 343/700 MS

(58) Field of Search ..... 343/700 MS, 702, 343/793, 794, 795, 820, 822, 846, 810

(56) References Cited

U.S. PATENT DOCUMENTS

| | | | | |
|---|---|---|---|---|
| 4,138,684 | A | 2/1979 | Kerr | 343/846 |
| 4,356,492 | A | 10/1982 | Kaloi | 343/700 |
| 5,386,215 | A | 1/1995 | Brown | 343/795 |
| 5,557,293 | A | 9/1996 | McCoy et al. | 343/867 |
| 5,625,371 | A | 4/1997 | Miller et al. | 343/867 |
| 5,657,028 | A | 8/1997 | Sanad | 343/700 |
| 5,680,144 | A | 10/1997 | Sanad | 343/700 |
| 5,680,438 | A | 10/1997 | Beesley | 379/58 |
| 5,742,258 | A | 4/1998 | Kumpfbeck et al. | 343/795 |
| 5,754,145 | A | 5/1998 | Evans | 343/795 |
| 5,757,333 | A | 5/1998 | Kitchener | 343/826 |
| 5,767,812 | A | 6/1998 | Basciano et al. | 343/722 |
| 5,867,130 | A | 2/1999 | Tay et al. | 343/795 |
| 5,933,115 | A | 8/1999 | Faraone et al. | 343/700 |
| 6,031,503 | A | 2/2000 | Preiss, II et al. | 343/770 |

FOREIGN PATENT DOCUMENTS

| | | | |
|---|---|---|---|
| WO | 96/37922 | 11/1996 | H01Q/3/32 |
| WO | 98/34295 | 8/1998 | H01Q/21/06 |
| WO | 99/03168 | 1/1999 | H01Q/1/24 |
| WO | 99/05754 | 2/1999 | H01Q/21/06 |
| WO | 99/31757 | 6/1999 | H01Q/1/38 |

*Primary Examiner*—Don Wong
*Assistant Examiner*—Shih-Chao Chen
(74) *Attorney, Agent, or Firm*—Fulbright & Jaworski L.L.P.

(57) ABSTRACT

A diversity antenna structure for a wireless communication device for receiving and transmitting communication signals is provided. The antenna structure including a dielectric substrate defining a pair of major surfaces and having a conductive reflector element disposed upon one of the major surfaces of the dielectric substrate, said reflector element being operatively coupled to a pair of shield conductors of coax feedlines. The antenna further including a plurality of serpentine radiator elements conductively coupled to the reflector element. The antenna assembly also including a pair of transmission lines disposed upon the other major surface of the dielectric substrate substantially opposite the reflector element, each of the pair of transmission lines coupled to one of the center conductors of the coax feedlines, and a pair of conductive balun structures disposed upon the dielectric substrate and coupled to the pair of transmission lines, the baluns being disposed substantially opposite the plurality of serpentine radiators.

17 Claims, 4 Drawing Sheets

DIVERSITY ANTENNA SYSTEM FOR LAN COMMUNICATION SYSTEM

CROSS REFERENCE TO RELATED APPLICATION

This application claims the benefit of priority pursuant to 35 USC §119(e)(1) from the provisional patent application filed pursuant to 35 USC §111(b): as Ser. No. 60/148,909 on Aug. 13, 1999.

BACKGROUND OF THE INVENTION

1. Field of the Invention

The present invention relates to an antenna system for wireless communication devices, and more particularly to a simplified, low cost antenna system providing spatial diversity to combat multipath effects in communication systems.

2. Description of Related Art

Local area networks (LAN) are used in the wireless transmission and reception of digitally-formatted data between sites within a building, between buildings, or between outdoor sites, using transceivers operating at frequencies in the range 2.4–2.5 GHz., 5.2–5.8 GHz., and others. Antennas operating over these frequency bands are required for the transceivers in LAN devices. A LAN structure permits many devices, such as computers, to communicate with each other or with other devices such as servers or printers. The individual stations in a LAN may be randomly positioned relative the other stations in the LAN, therefore an omnidirectional antenna is often required for the LAN's transceivers. One drawback of an omnidirectional antenna is its susceptibility to multipath interference which can reduce signal strength by phase cancellation. This may result in unacceptable error rates for the digital information being transferred over a LAN.

In many wireless systems it is necessary to employ some form of antenna diversity to combat multipath effects in the communication system. The antenna diversity can be accomplished in the form of frequency diversity, time diversity, or spatial diversity. In frequency diversity, the system switches between frequencies to combat multipath interference. In time diversity systems, the signal is transmitted or received at two different times. In spatial diversity systems, two or more antennas are placed at physically different locations to combat multipath interference.

Many prior art systems use a pair of ceramic patch antennas to form a spatially diverse antenna configuration. A ceramic patch antenna typically includes a ceramic substrate, a metalized patch formed on one surface of the substrate, and a ground plane disposed on the opposite surface of the substrate. A feed hole couples the metallized patch to the receiver/transmitter. The use of high dielectric constant materials for the ceramic substrate results in an antenna which is physically small. However, ceramic patch antennas tend to be relatively expensive. Furthermore, connecting the antenna to a low cost circuit board often requires special connectors and cabling, which add cost to the system.

SUMMARY OF THE INVENTION

A compact diversity antenna system for use with a communication system such as a LAN (local area network) is described. The antenna system consists of two moderately directional arrays disposed back-to-back, with separate rf feed ports for each array. The construction of the arrays is unique in the use of a common reflector element with two driven elements. Further, the driven elements are compact, and provide electrical performance nearly equal to full-size elements. The antenna volume has been minimized, making the antenna suitable for internal or external mounting on LAN devices. The antennas are formed by conductive traces on a first major surface of a dielectric substrate, such as a printed wiring board. Balun/feed networks are provided on a second, parallel major surface of the substrate. The balun traces are microstrip transmission lines using the wide reflector element trace on the first surface as a ground plane.

The antenna of the present invention provides two rf ports, each connected to a moderately directional antenna. The two patterns of the antennas effectively isolate azimuth sectors of 180 degrees, with maximum isolation to the rear of an array and maximum gain to the front of an array. In this way appropriate circuitry in a LAN device's transceiver can switch between antenna ports and select the antenna with maximum signal strength. Multipath signals coming from directions other than that of the strongest signal will be attenuated.

Additional objects of the antenna system according to the present invention include the provision of a compact, low cost antenna fabricated on a printed circuit board.

Other aspects and advantages of the invention are disclosed upon review of the figures, the detailed description, and the claims which follow.

DESCRIPTION OF THE DRAWINGS

The accompanying drawings, which are incorporated in and form a part of this specification, illustrate preferred embodiments of the invention. In the drawings.

DESCRIPTION OF PREFERRED EMBODIMENTS OF THE INVENTION

Figure 1:
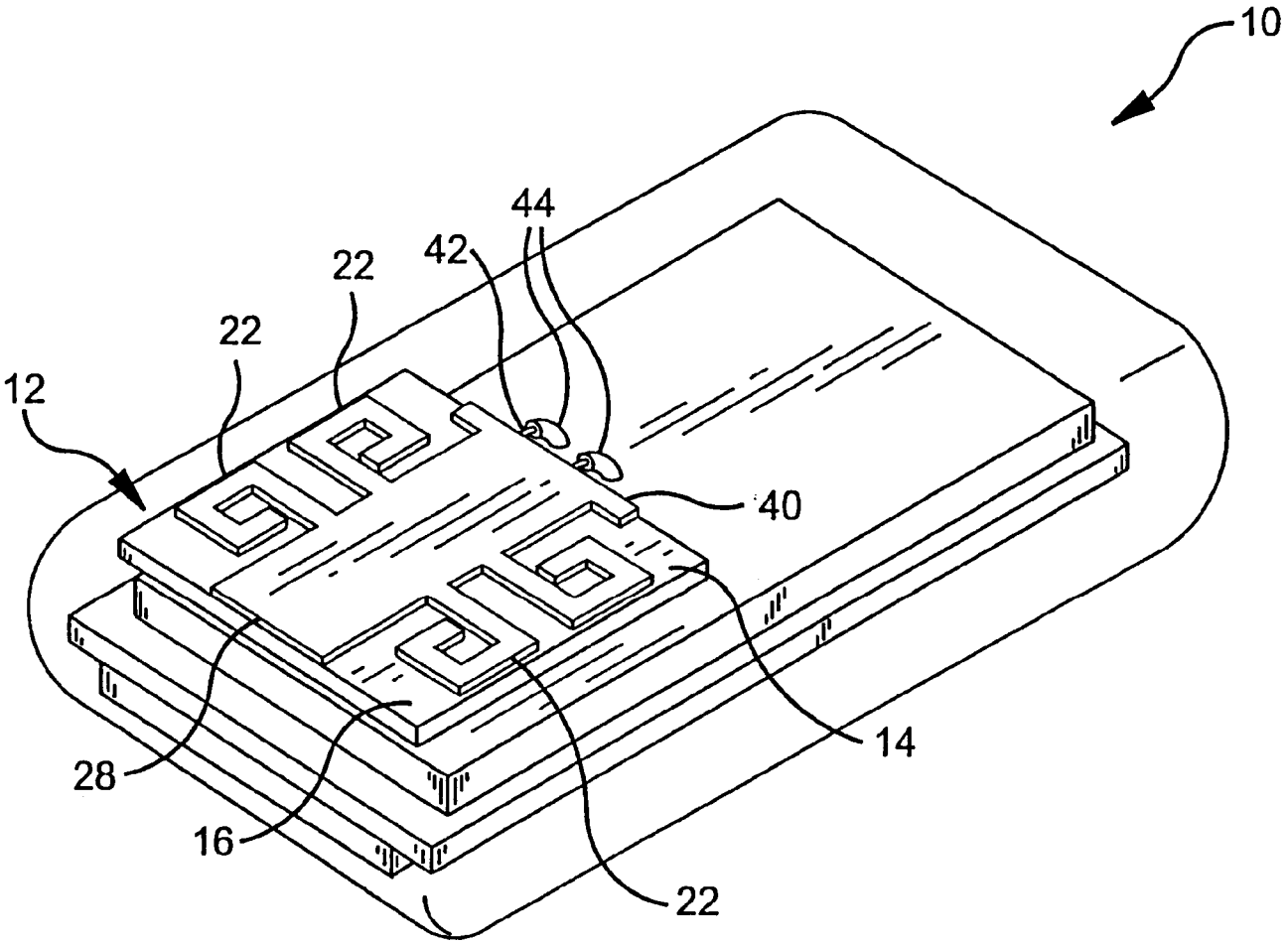
FIG. 1 illustrates a perspective view of a wireless communication device utilizing an antenna assembly according to the present invention.
Figure 4:
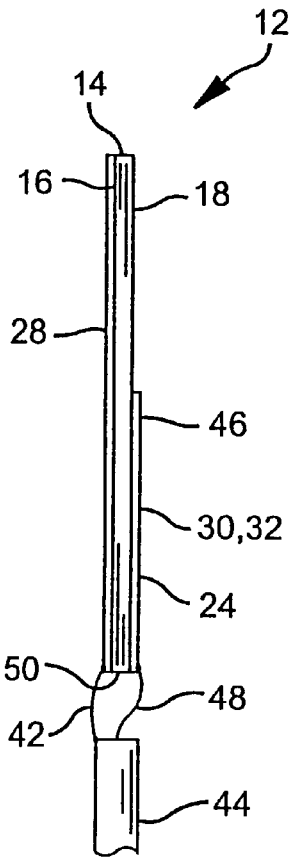
FIG. 4 is a side elevational view of the antenna assembly of FIG. 1.
Figure 3:
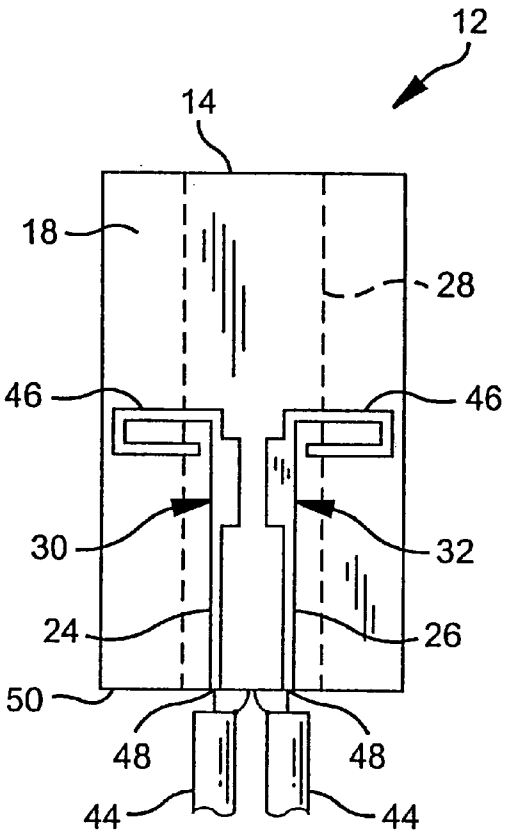
FIG. 3 is a top plan view of the antenna assembly of FIG. 1.
Figure 2:
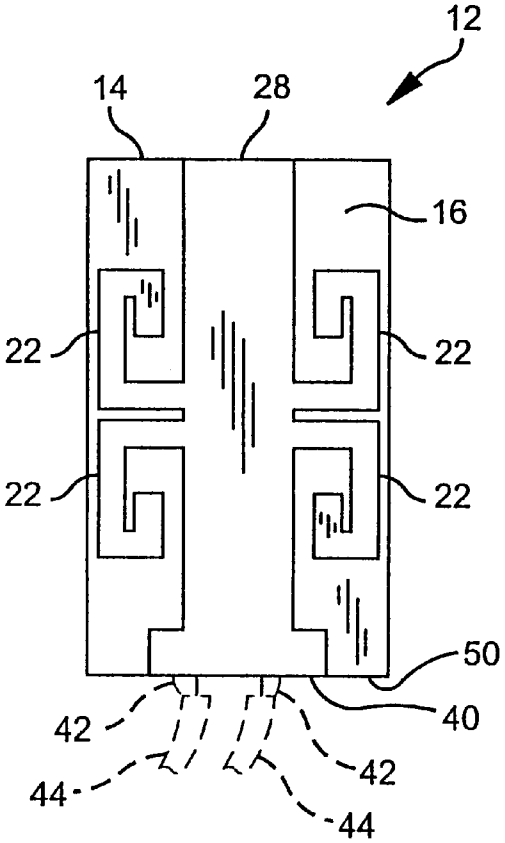
FIG. 2 bottom plan view of the antenna assembly of FIG. 1.

Referring to FIG. 1, a wireless communication device 10 utilizing an antenna assembly 12 according to the present invention is illustrated. Wireless communication device 10 may include a computer, printer device, or other LAN functional devices. FIGS. 2–4 further illustrate the antenna assembly 12 of FIG. 1. Antenna assembly 12 includes a substrate 14 upon which one or more small substantially flat antennas may be positioned. The substrate is preferably substantially planar, though alternative configurations may be practicable. The substrate 14 may be a printed circuit board manufactured of epoxy resin/glass cloth laminate, but other compounds may also be used. The substrate 14 has a relative dielectric constant of 1–10 with a preferred value of 4.5. The substrate preferably has a thickness of between 0.010–0.25 inches. The substrate 14 defines first and second substantially parallel major surfaces 16,18 upon which conductive structures 20 of the antenna assembly 12 are disposed. Conductive structures 20, including radiator elements 22, transmission line traces 24,26, reflector element 28, and impedance matching tabs 30,32, have preferred thickness of 0.001–0.002 inches. Although in the preferred embodiment, the conductive structures 20 are shown etched upon the substrate 14, it will be recognized by those skilled in the art that ordinary wire conductors may also be used and disposed on the substrate 14.

Referring particularly to FIG. 2, the conductive structure 20 of the first major surface 16 of the dielectric substrate 14 includes a plurality of fed radiating elements 22 in relation to a common reflector element 28. Fed elements 22 consist of generally J-shaped traces whose serpentine shape form a radiator as the monopole antenna. Alternative shapes or forms for the radiator segments may be practicable. In the preferred embodiment, four fed elements 22 are defined by serpentine segments and are disposed in symmetric and reflective relation to the common reflector element 28. The four fed elements 22 are symmetrically disposed relative to both longitudinal and transverse centerlines of the dielectric substrate 14. The common reflector element 28 includes a base portion 40 for coupling the reflector element 28 to the shield conductors 42 of the coax feedlines 44, as will be described hereinafter.

Referring to FIG. 3, the second major surface 18 of the dielectric substrate 14 has conductive structures 20 including two microstrip transmission lines 24,26, impedance matching tabs 30,32, and baluns 46. The microstrip transmisson lines 24,26 utilize the common reflector element 28 on the reverse major surface 16 as a ground plane. The microstrip transmission lines 24,26 are coupled at a first end to a pair of center conductors 48 of the coax feedlines 44 at a substrate edge 50, and at a second end to the pair of balun structures 46. Baluns 46 or matching networks are configured as serpentine conductive traces and provide a means for coupling rf power to the driven radiator elements 22. In a preferred embodiment, the baluns 46 are symmetrically disposed relative to a longitudinal center line of the dielectric substrate 14. Conductive structures 20 of the second major surface 18 further include a pair of impedance matching tabs 30,32, each associated with a transmission line 24,26 and a balun 46.

Referring to FIG. 4, a pair of 50 ohm coax signal lines 44 from the wireless communications device 10 may be coupled between the conductive structures 20 of the first and second major surfaces 16,18 of the dielectric substrate 14. In a preferred embodiment, the edge 50 of the substrate 14 may be contiguous with a portion of the printed circuit substrate of a communications device 10, and microstrip lines 24,26 may be connected to corresponding microstrip lines of the device 10 which corresponds to VSWR of less than 1.5:1.

Figure 5:
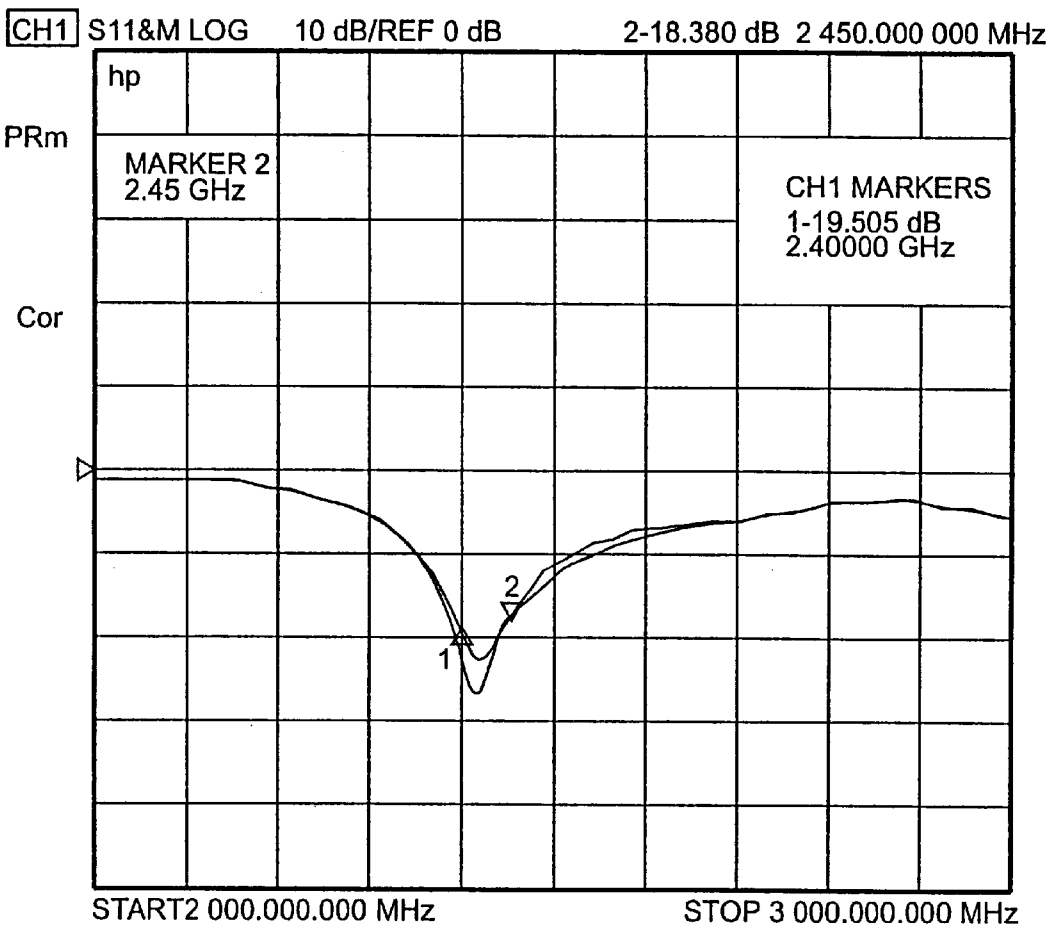
FIG. 5 shows the return loss vs. frequency plot for each antenna of the preferred configuration from FIG. 1.

Referring to FIG. 5, markers 1 & 2 are at frequencies 2.40 and 2.45 GHz., respectively. Minimum return loss at the feed locations is seen to be 17 dB, assuring efficient power transfer.

Figure 6:
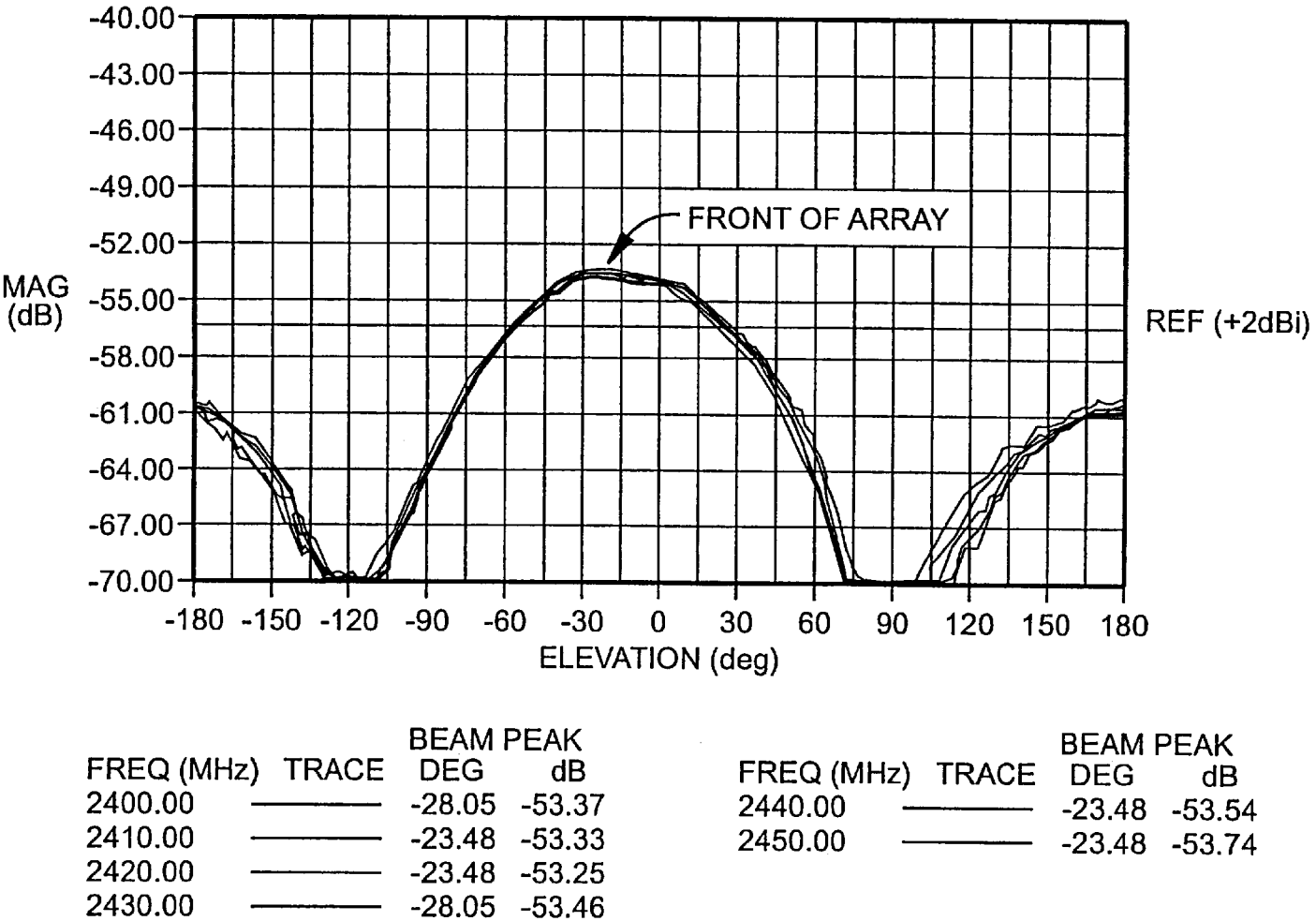
FIG. 6 shows the free-space azimuth pattern, gain, and front to back ratio of the preferred configuration from FIG. 1.

Referring to FIG. 6, the peak gain over the frequency range 2.4–2.45 GHz is +5 dBi, and the front-to-back ration is 7.5 dB.

Although particular embodiments of the invention have been illustrated in the accompanying Drawings and described in the foregoing Detailed Description, it will be understood that the invention is not limited only to the embodiments disclosed, but is intended to embrace any alternatives, equivalents, or modifications falling within the scope of the invention as defined by the following claims.

We claim:

1. A diversity antenna structure for a wireless communication device for receiving and transmitting communication signals, said wireless communication device providing a pair of coax feedlines, each feedline having a center conductor and a shield conductor, said antenna structure comprising:

a dielectric substrate defining a pair of major surfaces;

a conductive reflector element disposed upon one of the major surfaces of the dielectric substrate, said reflector element being operatively coupled to the pair of shield conductors of the coax feedlines;

a plurality of serpentine radiator elements disposed upon said one of the major surfaces of the dielectric substrate, each of the plurality of radiator elements having a first and second end, and each of the plurality of radiator elements conductively coupled at a first end to the reflector element;

a pair of transmission lines disposed upon the other major surface of the dielectric substrate substantially opposite the reflector element, each of the pair of transmission lines coupled to one of the center conductors of the coax feedlines; and a pair of conductive balun structures disposed upon the dielectric substrate and coupled to the pair of transmission lines, said pair of conductive balun structures being disposed substantially opposite the plurality of serpentine radiator elements.

2. An antenna structure of claim 1, wherein the reflector element is elongated in form, having a length that is substantially greater than a width.

3. An antenna structure of claim 1, wherein the plurality of radiator elements include disposed proximate a middle portion of the reflector element.

4. An antenna structure of claim 1, wherein the radiator elements are four radiator elements, two disposed upon each side of the reflector element.

5. An antenna structure of claim 1, wherein the radiator elements are symmetrically disposed about a center point of the reflector element.

6. An antenna assembly of claim 1, wherein the shield conductors are coupled to the reflector element proximate an edge.

7. An antenna structure of claim 2, wherein the transmission lines are parallel to each other.

8. An antenna structure of claim 7, wherein the transmission lines are generally parallel to the elongated reflector element.

9. A diversity antenna structure for a wireless communication device for receiving and transmitting communication signals, said wireless communication device providing a pair of signal feed lines and a ground plane, said antenna structure comprising:

a dielectric substrate defining a pair of opposed major surfaces;

a conductive reflector element disposed upon one of the pair of major surfaces of the dielectric substrate, said reflector element being operatively coupled to ground plane of the wireless communication device;

a plurality of serpentine radiator elements disposed upon said one of the pair of major surfaces, each of the plurality of radiator elements having a first and second end, and each of the plurality of radiator elements conductively coupled at a first end to the reflector element;

a pair of transmission lines disposed upon the other major surface of the dielectric substrate substantially opposite the reflector element, each of the pair of transmission lines coupled to one of the signal feed lines; and a pair of conductive baluns structures disposed upon the other major surface and coupled to the pair of transmission lines, said pair of conductive balun structures disposed substantially opposite the plurality of serpentine radiators.

10. An antenna structure of claim 9, wherein the reflector element is elongated in form, having a length that is substantially greater than a width.

11. An antenna structure of claim 9, wherein the plurality of radiator elements are disposed proximate a middle portion of the reflector element.

12. An antenna structure of claim 9, wherein the radiator elements are four radiator elements, two disposed upon each side of the reflector element.

13. An antenna structure of claim 9, wherein the radiator elements are symmetrically disposed about a center point of the reflector element.

14. An antenna assembly of claim 9, wherein the ground plane is coupled to the reflector element proximate an edge.

15. An antenna structure of claim 10, wherein the transmission lines are parallel to each other.

16. An antenna structure of claim 15, wherein the transmission lines are generally parallel with the elongated reflector element.

17. An antenna structure of claim 10, wherein the dielectric substrate is substantially planar.

* * * * *